US008732995B2

(12) United States Patent
Herzog et al.

(10) Patent No.: US 8,732,995 B2
(45) Date of Patent: May 27, 2014

(54) METHOD AND APPARATUS FOR FEEDING A LAUNDRY ARTICLE TO A MANGLE OR THE LIKE

(75) Inventors: Lars Herzog, Bielefeld (DE); Jurgen Sielermann, Heubach (DE); Friedhelm Mehrhoff, Hille (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 665 days.

(21) Appl. No.: 12/962,151

(22) Filed: Dec. 7, 2010

(65) Prior Publication Data

US 2011/0142576 A1 Jun. 16, 2011

(30) Foreign Application Priority Data

Dec. 16, 2009 (DE) ..... 10 2009 058 637

(51) Int. Cl.
*D06F 67/04* (2006.01)
*B65G 49/00* (2006.01)

(52) U.S. Cl.
USPC ..... 38/143

(58) Field of Classification Search
USPC ..... 38/7, 8, 143; 198/456, 570, 574
See application file for complete search history.

(56) References Cited

U.S. PATENT DOCUMENTS

| | | | | |
|---|---|---|---|---|
| 3,376,036 | A * | 4/1968 | Weir | 38/143 |
| 3,664,046 | A * | 5/1972 | Thompson | 38/143 |
| 3,911,604 | A * | 10/1975 | Sjostrom | 38/143 |
| 5,416,991 | A * | 5/1995 | Jensen | 38/143 |
| 5,440,810 | A * | 8/1995 | Borucki et al. | 38/143 |
| 8,028,444 | B2 * | 10/2011 | Heinz et al. | 38/143 |

* cited by examiner

*Primary Examiner* — Ismael Izaguirre
(74) *Attorney, Agent, or Firm* — Laurence P. Colton; Smith Risley Tempel Santos LLC

(57) ABSTRACT

Laundry articles are spread out by input machines in front of a feed conveyor which feeds the spread-out laundry article to a mangle. The respective laundry article is previously fed by a transfer device to a draw-on device onto which the laundry article is drawn. In known input machines, relatively complicated transfer devices are provided. According to the invention, the transfer device is provided with a rectilinear conveying section ascending to the draw-on device. The laundry article is thereby transported to the draw-on device by the transfer device in the plane in which it is transferred to the transfer device. Such a transfer device needs to have only a simple set-up. Since the laundry article remains in the plane in which it is fed to the transfer device, it can be brought by the transfer device into a favorable initial position for being drawn reliably onto the draw-on device.

15 Claims, 13 Drawing Sheets

METHOD AND APPARATUS FOR FEEDING A LAUNDRY ARTICLE TO A MANGLE OR THE LIKE

BACKGROUND OF THE INVENTION

1. Technical Field

The invention relates to a method for feeding a laundry article to a mangle or the like, the laundry article being transferred from at least one transfer device to a draw-on device, being drawn over the draw-on device and, preferably spread out by spreading pegs, being deposited onto a feed conveyor which inputs the spread-out laundry article into the mangle or the like, Method for feeding a laundry article (20) to a mangle or the like; or the laundry article being drawn over a draw-on device, so that parts of the laundry article hang down on both sides from the draw-on device, the laundry article preferably being spread out by spreading pegs, and the spread-out laundry article being deposited onto a feed conveyor which feeds the laundry article in the spread-out state to the mangle or the like; or the laundry article being transported to a draw-on device by at least one transfer device and being drawn onto the draw-on device, the laundry article subsequently being spread out preferably by spreading pegs and then transferred to a feed conveyor which feeds the laundry article in the spread-out state to the mangle or the like. The invention relates, further, to a corresponding apparatus for feeding a laundry article to a mangle or the like, with at least one transfer device, with a draw-on device extending transversely with respect to the feed direction of the laundry article to the mangle or the like, if appropriate a spreading device and a feed conveyor for feeding the spread-out laundry article to the mangle or the like; or for feeding a laundry article to a mangle or the like, with at least one transfer device having a transfer peg, with a draw-on device extending transversely with respect to the feed direction of the laundry articles to the mangle or the like, if appropriate a spreading device and a feed conveyor for feeding the spread-out laundry article to the mangle or the like; or for feeding a laundry article to a mangle or the like, with at least one transfer device, with a draw-on device extending transversely with respect to the feed direction of the laundry articles to the mangle or the like, if appropriate a spreading device and a feed conveyor for feeding the spread-out laundry article to the mangle or the like.

2. Prior Art

Laundry articles, specifically, above all, flat laundry articles, such as bed laundry and table laundry, are fed automatically by input machines to a mangle or another laundry treatment machine. For this purpose, the respective laundry article is simply suspended manually on an input peg. The laundry article is subsequently spread out mechanically and is deposited onto a feed conveyor or a depositing strip assigned to the latter and is fed to the mangle or the like.

Various types of input machines are known. The invention relates to one such input machine in which the respective laundry article is drawn onto a draw-on device transversely with respect to the feed direction, is subsequently spread out preferably by spreading pegs and is transferred, in the spread-out state, to the feed conveyor or to a lay-on strip of the latter. In these known input machines, the transfer of the respective laundry article from the input station to the draw-on device has proved to be difficult especially when a plurality of input stations are provided. Furthermore, the transfer of the respective laundry article from the draw-on device to the spreading device, in particular the spreading pegs, has often proved to be unsatisfactory in practice.

BRIEF SUMMARY OF THE INVENTION

The object on which the invention is based is to provide a simple method and an apparatus for feeding laundry articles to a mangle or the like, which operate more reliably and, above all, also more quickly.

A method for achieving this object is a method for feeding a laundry article to a mangle or the like, the laundry article being transferred from at least one transfer device to a draw-on device, being drawn over the draw-on device and, preferably spread out by spreading pegs, being deposited onto a feed conveyor which inputs the spread-out laundry article into the mangle or the like, characterized in that the laundry article hanging at least partially in one plane is transferred in the same plane by the respective transfer device into a transfer position to the draw-on device. Accordingly, there is provision whereby laundry articles hanging at least partially in one plane are transferred in the plane by the transfer device into a transfer position to the draw-on device. Thus, when being transported into the transfer position, the laundry article maintains the plane in which it is suspended on a peg at an input station. The laundry article does not need to be reoriented. The transfer device can thereby have a simple design, because it requires essentially only one rectilinear conveying section on which the laundry article arrives at the transfer position to the draw-on device without reorientation in the plane.

The laundry article hangs down from the transfer device partially in a vertical plane. This plane is intersected, preferably perpendicularly, by the draw-on direction. The transfer device thus transports the hanging-down laundry article into the transfer position transversely with respect to the draw-on direction.

A further method for independently achieving the object mentioned in the introduction, although possibly also being a preferred development of the method described above, is a method for feeding a laundry article to a mangle or the like, the laundry article being drawn over a draw-on device, so that parts of the laundry article hang down on both sides from the draw-on device, the laundry article preferably being spread out by spreading pegs, and the spread-out laundry article being deposited onto a feed conveyor which feeds the laundry article in the spread-out state to the mangle or the like, characterized in that the spacing between the parts of the laundry article which hang down from the draw-on device is increased, in particular that part of the laundry article which points towards the feed conveyor is moved in the direction towards the feed conveyor. Accordingly, there is provision whereby the spacing between the parts of the laundry article which hang down on both sides from the draw-on device is increased. Preferably, that part of the laundry article which lies adjacently to the feed conveyor is moved in the direction towards the feed conveyor, with the result that the spacing between this part of the laundry article and the feed conveyor decreases or this part may even come into contact with that part of the feed conveyor which lies at the front in the feed direction. This makes it easier to transfer the laundry article to the feed conveyor.

In a preferred development of the method, part of the laundry article is moved in the direction towards the feed conveyor as a result of a rotation of a discharge conveyor or draw-on conveyor of the draw-on device. This procedure does not necessitate any appreciable additional outlay in terms of equipment.

A further method for independently achieving the object mentioned in the introduction, although also possibly being a preferred development of at least one method described above, is a method for feeding a laundry article to a mangle or the like, the laundry article being transported to a draw-on device by at least one transfer device and being drawn onto the draw-on device, the laundry article subsequently being spread out preferably by spreading pegs and then transferred to a feed conveyor which feeds the laundry article in the spread-out state to the mangle or the like, characterized in that the laundry article is input manually with an edge region into an input peg of the respective transfer device, transfer of the laundry article from the input peg to a transfer peg of the respective transfer device subsequently takes place, or the laundry article is input manually with an edge region into a transfer peg, and the laundry article is transferred from the transfer peg to a draw-on peg of the draw-on device. According to this method, the laundry article is input manually with an edge region into an input peg. Everything else takes place mechanically, in that that edge region of the laundry article which hangs in the input peg is transferred automatically to a transfer peg of the transfer device, and subsequently the edge region of the laundry article is transferred automatically from the transfer peg to a draw-on peg of the draw-on device. Suspending the edge region of the laundry article manually in the input peg constituting a holding peg results in buffering, to be precise in that the operator can input the edge region of a following laundry article into the holding peg when the transfer peg of the transfer device is still occupied. Alternatively, the respective laundry article can also be input manually with an edge region into the respective transfer peg.

In a development of the method, the edge region is held in a preferably vertical orientation by the input peg, while the draw-on peg takes over the edge region in a different orientation, in particular in an inclined or horizontal orientation. Such positions make the input or transfer of the edge region of the laundry article easier.

In an especially advantageous refinement of the method, the edge region is held by the transfer peg in an orientation which deviates from the orientation of the edge region both in the input peg and in the draw-on peg. Preferably, the edge region is held by the transfer peg in an orientation which lies between the orientation of the edge region in the input peg and that in the draw-on peg. Thus, a partial reorientation of the edge region takes place during the take-over of the edge region from the input peg by the transfer peg. Preferably, there is provision whereby the orientation of the edge region in the transfer peg lies between the vertical orientation of the edge region in the input peg and the horizontal orientation of the edge region in the draw-on peg.

An apparatus for achieving the object mentioned in the introduction is an apparatus for feeding a laundry article to a mangle or the like, with at least one transfer device, with a draw-on device extending transversely with respect to the feed direction of the laundry article to the mangle or the like, if appropriate a spreading device and a feed conveyor for feeding the spread-out laundry article to the mangle or the like, characterized in that the or each transfer device has a rectilinear conveying section which runs transversely with respect to the draw-on direction of the laundry article onto the draw-on device. This apparatus provides a transfer device having a rectilinear conveying section, the rectilinear conveying section of the transfer device running transversely with respect to the draw-on direction of the laundry article onto the draw-on device. By virtue of the rectilinear conveying section, the transfer device can have a very simple set-up. The conveying section running at right angles to the draw-on device makes it easier to transfer the laundry article onto the draw-on device.

Preferably, there is provision whereby the conveying section of the respective transfer device runs upwards in the direction towards the draw-on device. The laundry article is thereby raised on the path to the draw-on device, as a result of which the laundry article hangs down freely completely or at least for the most part under the transfer peg at the latest upon reaching the transfer position to the draw-on device and the laundry article is thereby previously spread out, with the result that it can be drawn onto the draw-on device simply and reliably.

A further apparatus for independently achieving the object mentioned in the introduction, although also possibly being a preferred development of the apparatus described above, is an apparatus for feeding a laundry article to a mangle or the like, with at least one transfer device having a transfer peg, with a draw-on device extending transversely with respect to the feed direction of the laundry articles to the mangle or the like, if appropriate a spreading device and a feed conveyor for feeding the spread-out laundry article to the mangle or the like, characterized in that the transfer peg of the respective transfer device is assigned an input peg. Accordingly, the respective transfer device has a transfer peg and an input peg assigned to the latter. The respective laundry article is input manually with a stretched edge region into the input peg. The input peg subsequently prepares the laundry article for the transfer peg. As a result of the input peg which precedes the transfer peg, the operator does not need to wait until the transfer peg is ready for receiving the next laundry article. The edge region extends only over a small, approximately central part of any edge or any margin of the laundry article. The operator therefore needs only to stretch this small part of a margin or edge of the laundry article in order to input the latter into the input peg.

In an advantageous further refinement of the apparatus, the input peg can be moved for the transfer of the edge region of the laundry article into the transfer peg. Preferably, the edge region is moved rectilinearly by the input peg. This rectilinear movement of the laundry article or of the edge region to the transfer peg takes place, in particular, vertically, that is to say in the plane in which the laundry article can be moved by the transfer peg into a transfer position to the draw-on peg. Since the input peg is movable with respect to the transfer peg, the input operation into the input peg can be decoupled from the transfer operation onto the draw-on device. While the transfer peg is transferring the laundry article to the draw-on peg, the input peg is ready to receive an edge region of the next laundry article.

A further independent solution for achieving the object mentioned in the introduction, although also possibly being a preferred development of at least one of the apparatuses described above, is an apparatus for feeding a laundry article to a mangle or the like, with at least one transfer device, with a draw-on device extending transversely with respect to the feed direction of the laundry articles to the mangle or the like, if appropriate a spreading device and a feed conveyor for feeding the spread-out laundry article to the mangle or the like, characterized in that the draw-on device has a draw-on conveyor of variable width, the conveying direction of which corresponds to the feed direction of the laundry article to the mangle or the like. In this case, the draw-on device has a discharge conveyor of variable width which may also be designated as a draw-on conveyor. The conveying direction of the discharge conveyor corresponds to the feed direction of the laundry article to the mangle or the like. By means of the discharge conveyor of variable width, the spacing between the parts of the laundry article which hang down on both sides from said discharge conveyor can be varied. Preferably, the front part, pointing in the feed direction to the feed conveyor, of the laundry article can be moved forwards in the feed direction when the width of the discharge conveyor is being increased. As a result, the front part of the laundry article can be brought simply and reliably into a transfer position on the spreading device and/or to the feed conveyor or a lay-on strip of the latter.

Preferably, the apparatus is designed such that an upper strand of the discharge conveyor, onto which upper strand the laundry article can be drawn, can be widened in the direction towards the feed conveyor. As a result of the widening of the upper strand of the discharge conveyor, the parts of the laundry article which hang down on both sides from the latter are moved apart from one another.

In a further preferred refinement of the apparatus, the discharge conveyor is designed as a belt conveyor with two parallel drums, at least one drum of which can be driven. The axes of rotation of the drums extend transversely with respect to the feed direction. The belt conveyor has a fixed drum and a movable drum, the movable drum being pivotable about an axis of rotation of the fixed drum. When the movable drum is pivoted about the fixed drum such that the drums lie approximately next to one another, the upper strand has the maximum width. This width can be adapted according to the requirements by means of a corresponding spacing between the axes of rotation of the drums.

BRIEF DESCRIPTION OF THE DRAWINGS

A preferred exemplary embodiment of the invention is explained in more detail below by means of the drawing in which.

DETAILED DESCRIPTION OF PREFERRED EMBODIMENTS

Figure 1:
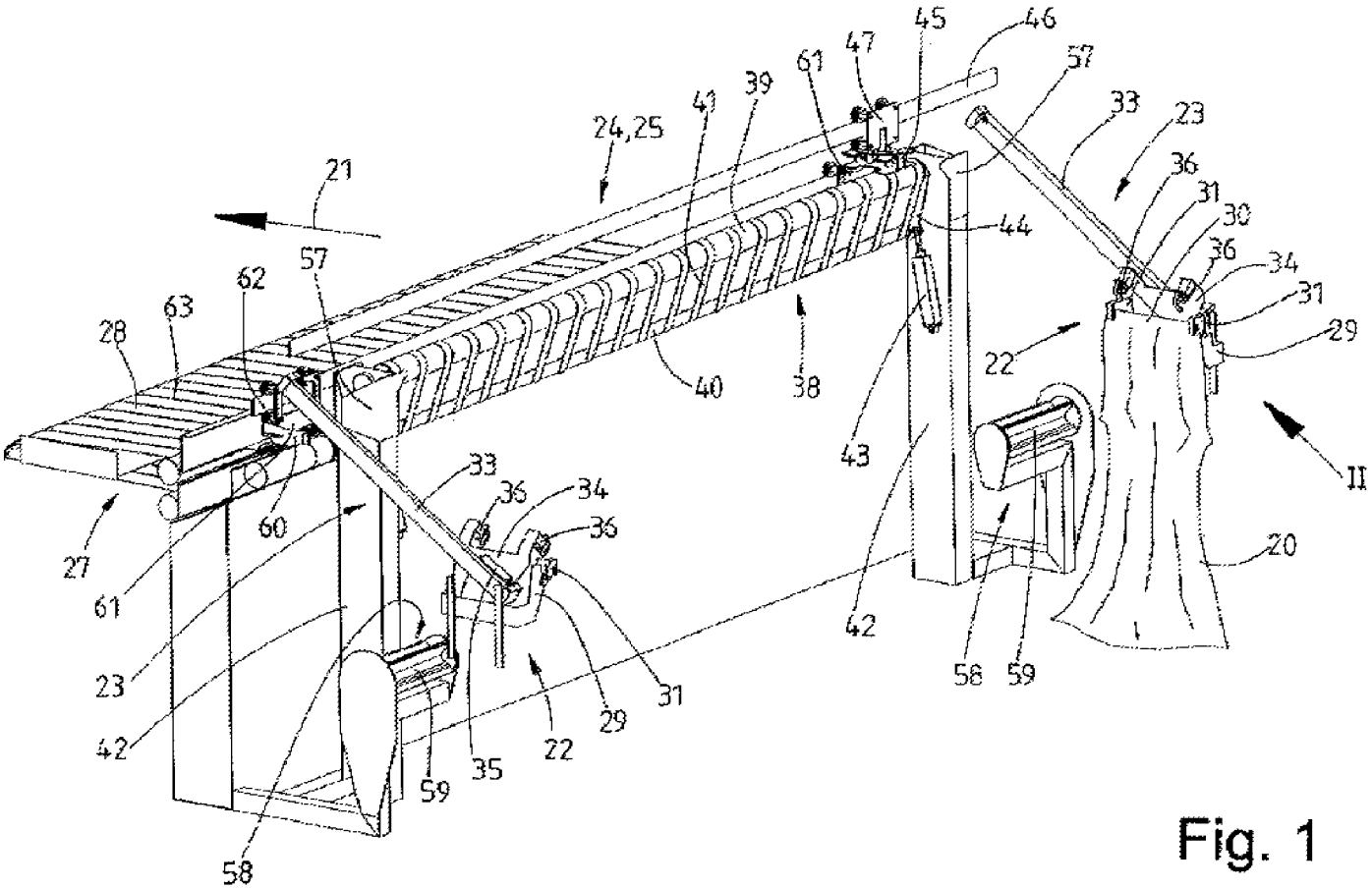
FIG. 1 shows an overall perspective view of the apparatus in an initial position.

The apparatus shown here is an input machine for what is known as the single-edge input of a laundry article 20 in each case into a mangle or another laundry treatment machine. The laundry articles 20 are transported to the mangle by the apparatus in the feed direction 21 and are input in the stretched-out state into the mangle or the like. The apparatus shown here has two parallel input stations 22. An input station 22 is arranged on each of the opposite sides of the apparatus. The input stations 22 are designed identically, but are assigned mirror-symmetrically to the opposite sides of the apparatus, specifically such that the operator stands between the input stations 22. It is also conceivable that the apparatus has a larger number of input stations 22, preferably four input stations 22, or only a single input station 22.

Each input station 22 is assigned an identically designed, but mirror-symmetrically oriented transfer device 23. The transfer devices 23 are assigned to opposite ends of a draw-on device 24 extending transversely with respect to the feed direction 21. The draw-on device 24 is followed in the feed direction 21 by a spreading device for spreading out the laundry article 20. The spread-out laundry article 20 is transferred with a stretched horizontal edge to a feed conveyor 27 by the spreading device 25. In the feed conveyor 27 shown here, this transfer of the laundry article 20 takes place onto the upper strand of its conveyor belts 28. The invention is also suitable, however, for apparatuses in which the feed conveyor 27 is assigned a lay-on strip, onto which a front edge region of the laundry article 20 is deposited by the spreading device 25. The input strip then deposits the laundry article 20 onto the conveyor belt 28 of the feed conveyor 27.

Each of the identically designed input stations 22 has an input peg 29, onto which the operator suspends any edge region of the laundry article 20 manually. In this edge region 30, which extends only over part of the entire length of the respective edge, the laundry article 20 is stretched, to be precise held with a taughtened margin in the input peg 29. For this purpose, the input peg 29 shown here is provided with two parallel individual pegs 31 which are spaced apart from one another and fix the edge region 30 at opposite ends and which thereby maintain the stretch of the edge region 30 between the individual pegs 31 of the input peg 29. The input peg 29 is arranged at a height above the floor which is ergonomically beneficial for the operator, so that a large part of the laundry article 20 hangs vertically downwards from the input peg 29. In the exemplary embodiment shown, a lower part of the laundry article 20 also lies on the floor. The input peg 29 is oriented in such a way that the edge region 30, in particular the smoothly drawn upper margin, runs horizontally in the feed direction 21. The peg jaws 32 of the individual pegs 31 are oriented vertically on the input peg 29.

Figure 2:
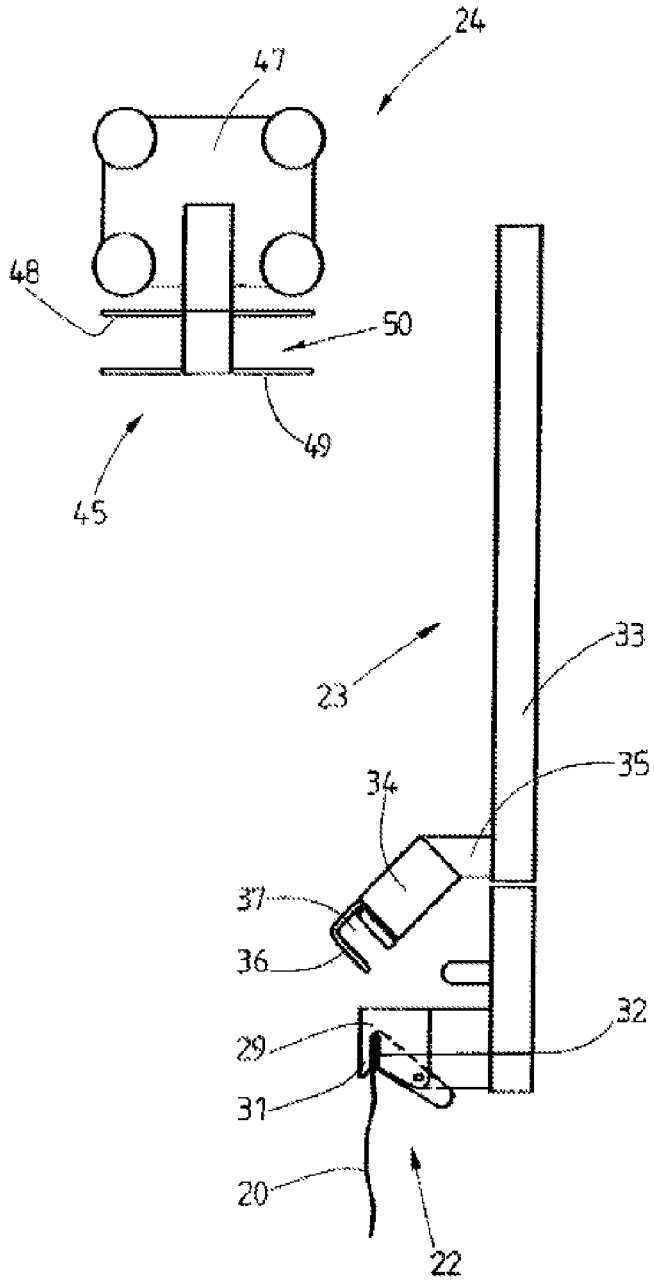
FIG. 2 shows a view II of one end face of a transfer device located in the initial position.
Figure 3:
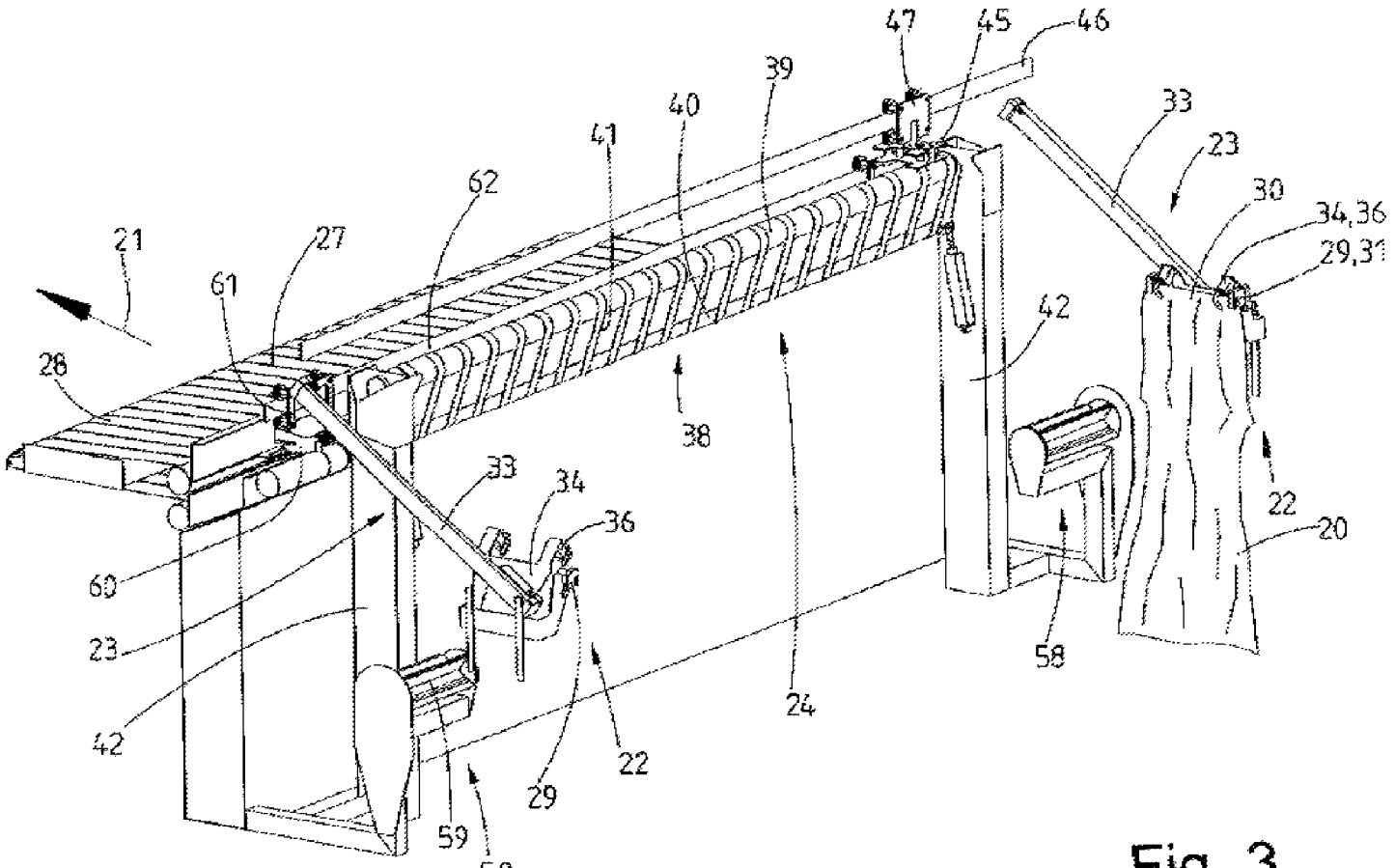
FIG. 3 shows a perspective view of the apparatus, similar to FIG. 1, with a laundry article taken over by a transfer peg of the transfer device.
Figure 4:
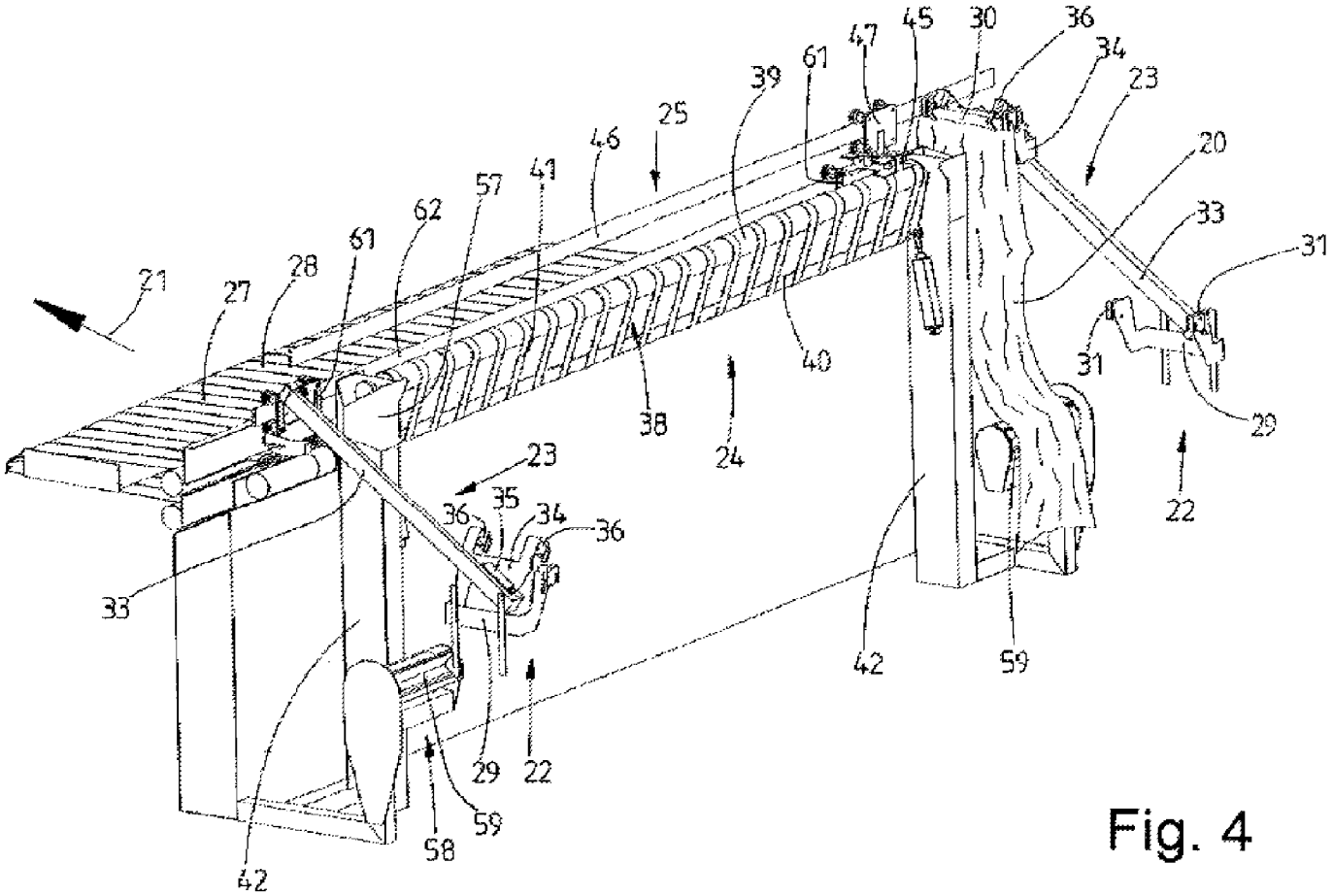
FIG. 4 shows a perspective view of the apparatus, similar to FIG. 1, before the transfer of the laundry article from the transfer peg to a draw-on peg.
Figure 5:
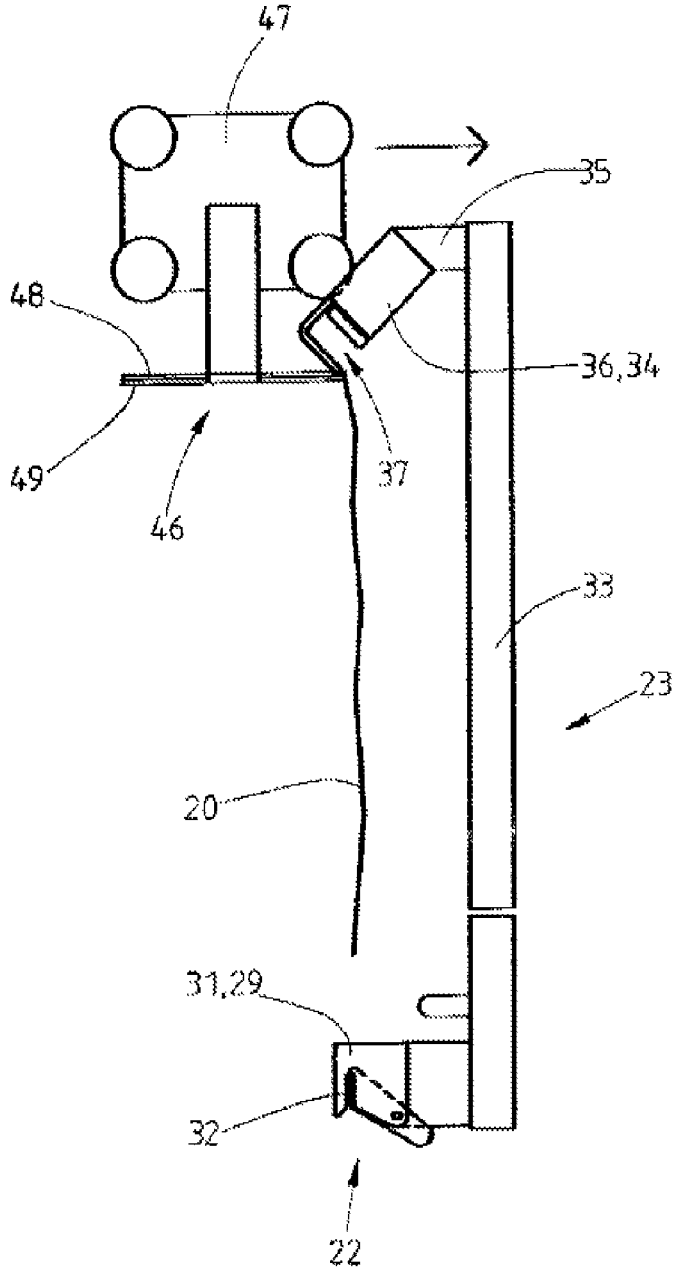
FIG. 5 shows a view of the transfer device, similar to FIG. 2, during the transfer of the laundry article to the draw-on peg.

In the apparatus shown here, each input peg 29 can be moved up and down, for example, by means of a pneumatic cylinder, so that the preferably approximately central edge region 30 can be raised in a vertical plane running parallel to the feed direction 21 (FIGS. 2 and 3).

Each of the identically designed transfer devices 23 on opposite sides of the draw-on device 24 has a rectilinear conveying section running in the feed direction 21. The conveying sections of the two transfer devices 23 run parallel to one another, specifically, in the exemplary embodiment shown, so as to ascend from the respective input station 22 to the draw-on device 24. However, the conveying sections may also run so as to ascend anti-parallel to one another. In the exemplary embodiment shown, the conveying section of each transfer device 23 is formed by a rectilinear ascending rail 33, on which a slide 35 carrying a transfer peg 34 can be moved.

The transfer peg 34, like the input peg 29, has two individual pegs 36 spaced apart from one another. The spacing between the individual pegs 36 is selected such that these fit between the individual pegs 31 of the input peg 29. The peg jaws 37 of the individual pegs 36 are directed obliquely on the transfer peg 34, specifically such that they run at about 45° to the vertical peg jaws 32 of the input peg 29. In this case, the open sides of the peg jaws 37 point obliquely downwards (FIG. 2). In the lower end position of the transfer peg 34, the individual pegs 36 of the latter are located above and between the individual pegs 31 of the input pegs 29 (FIG. 1). The transfer peg 34 can thereby be moved freely over the input peg 29. When the input peg 29 is moved up, the edge region 30 held stretched is pushed by the latter into the peg jaws 27 of the transfer peg 34 which are set obliquely at 45° (FIG. 3). An alternative exemplary embodiment of the apparatus, in which each transfer device 23 has only one transfer peg 34, that is to say no input peg 29, may also be envisaged. The operator then inputs an edge region of the respective laundry article 20 directly into the transfer peg 34.

The draw-on device 24 has a discharge conveyor 38, also to be designated as a draw-on conveyor, which is located in front of the spreading device 25 transversely with respect to the feed direction 21. The length of the discharge conveyor 38 corresponds to the operating width of the feed conveyor 27, so that the discharge conveyor 38 extends over the entire operating width of the apparatus. It is also conceivable, however, that the draw-on device 24 has two parallel draw-on conveyors.

Figure 9:
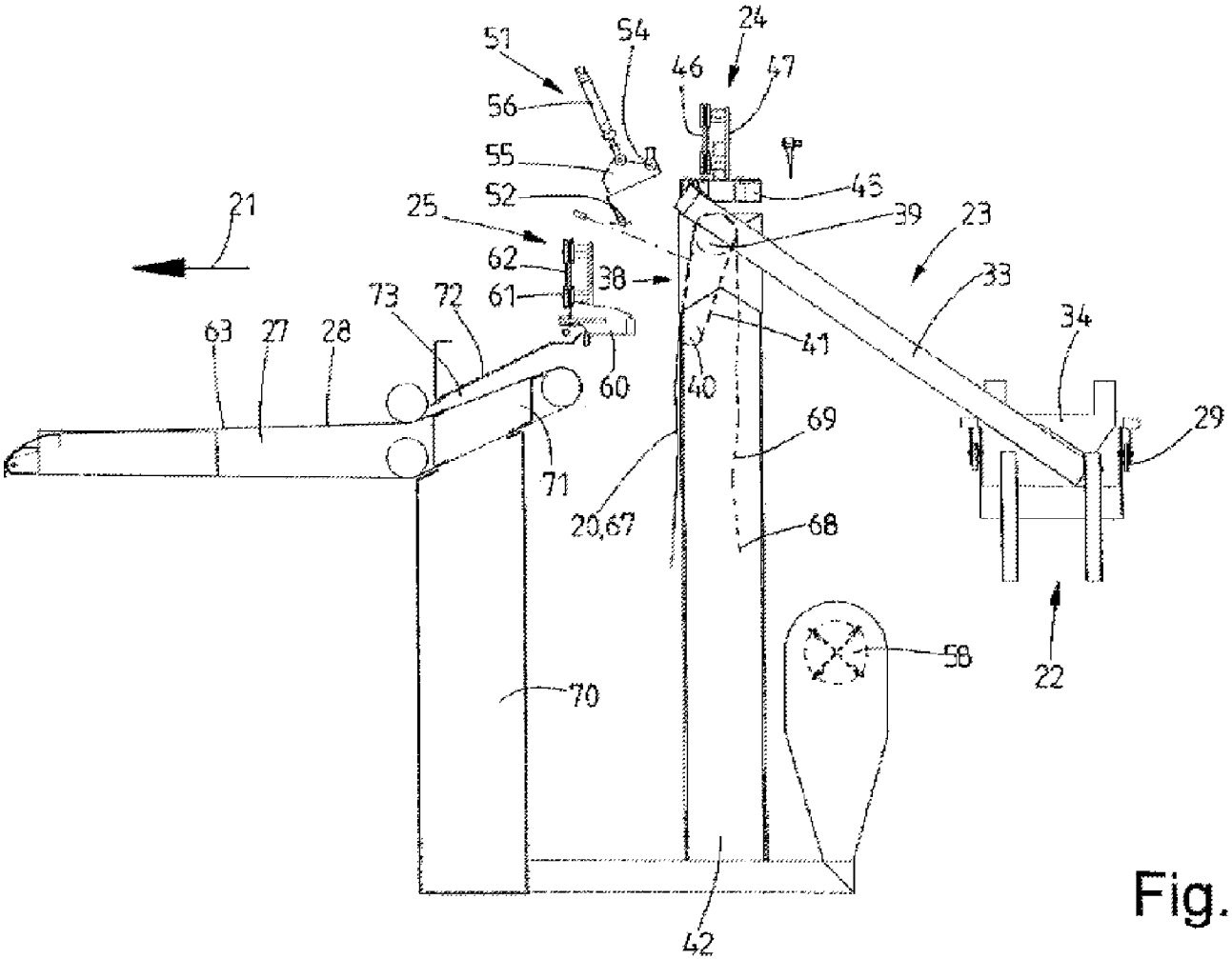
FIG. 9 shows a side view (transversely to the feed direction) of the apparatus, with a laundry article drawn onto the draw-on device, according to FIG. 8.
Figure 10:
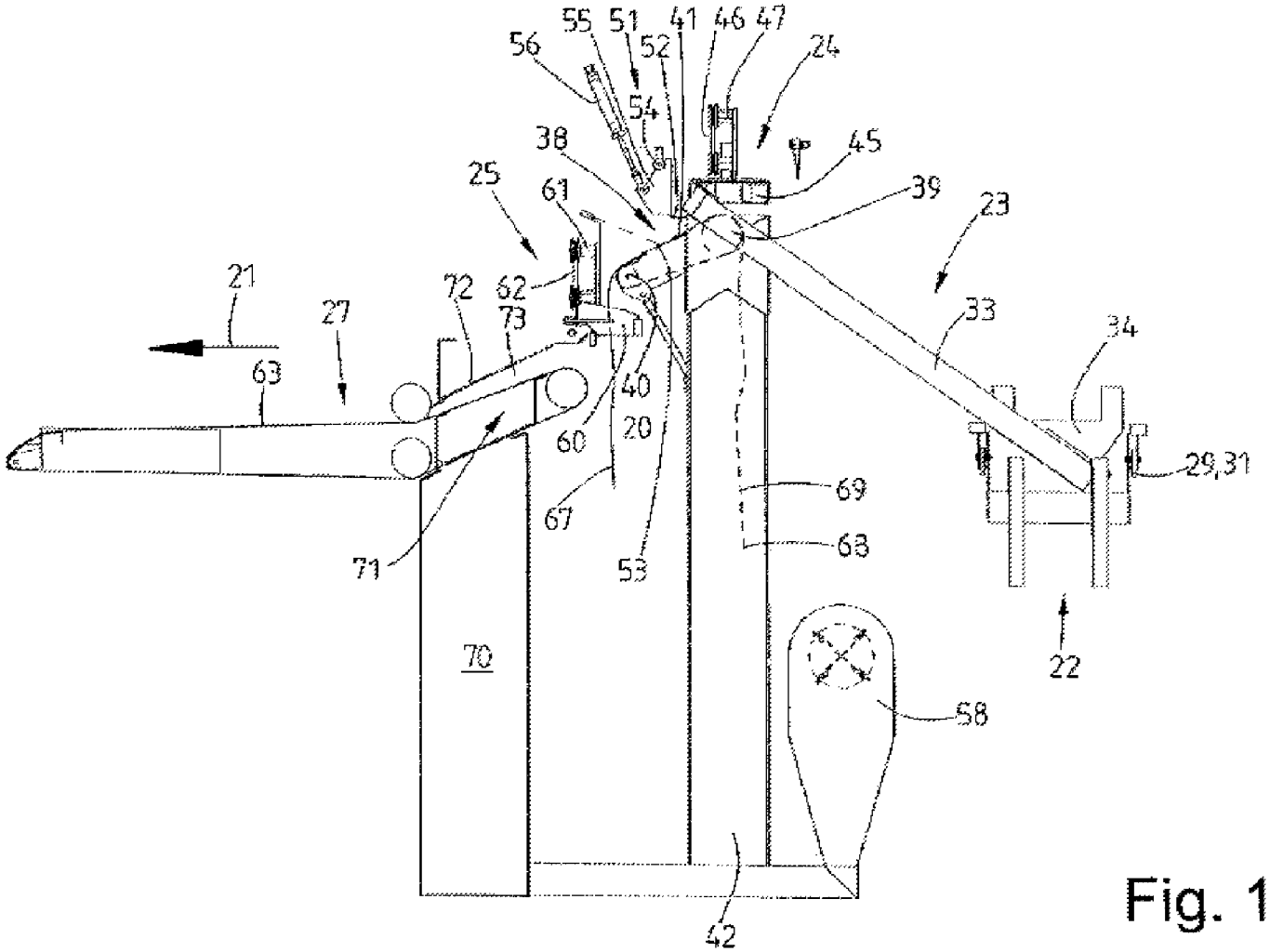
FIG. 10 shows a view of the apparatus, similar to FIG. 9, during the transfer of the laundry article to spreading pegs of a spreading device.

The discharge conveyor 38 is designed as a belt conveyor. For this purpose, the discharge conveyor 38 has two parallel horizontal rollers 39, 40, around which a plurality of belts 41 spaced apart from one another or only a single belt alone is guided. One of the rollers 39 or 40 is driven in rotation by a drive, not shown, while the other roller 39 or 40 is freely rotatable. One of the rollers 39, 40, specifically, in the exemplary embodiment shown (FIG. 1), the upper, somewhat larger roller 39, which is preferably also the driven roller, is mounted fixedly between opposite pillars 42 of the stand of the apparatus. The other (lower in the figure) roller 40 is mounted at each end on a pivoting arm 44 actuable by a pressure-medium cylinder 43. The pivoting arm 44 is pivotable about an axis of rotation of the upper, fixed roller 39. The pivot travel of the lower roller 40 about the axis of rotation of the upper roller 39 amounts to about 30° to 45°. In an initial position for drawing the laundry article 20 onto the discharge conveyor 38, the roller 40 is pivoted virtually under the roller 39. To transfer the laundry article 20 to the spreading device 25, the lower roller 40 is pivoted such that it is located laterally next to and somewhat below the upper roller 39 (FIG. 10). As a result, an upper strand 53 of the discharge conveyor 38, on which a middle part of the laundry article 20 drawn onto the discharge conveyor 38 lies, is widened, as compared with the position of the discharge conveyor 38 in which the roller 40 is pivoted virtually under the upper roller 39 (FIG. 9).

Above the discharge conveyor 38 is arranged a draw-on peg 45. The draw-on peg 45 can be moved on a fixed rail 46 extending over the entire operating width of the apparatus. The rail 46 runs rectilinearly in a horizontal direction transversely with respect to the feed direction 21. The draw-on peg 45 selectively serves the transfer peg 34 of the transfer device 23 at one end of the rail 46 or at the other. It is also conceivable that the apparatus has a plurality of draw-on pegs 45 movable in each case on a specific rail 46 over the entire operating width of the apparatus. For example, each transfer device 23 can then be assigned a draw-on peg 45. The draw-on peg 45 of one transfer device 23 then operates independently of the draw-on peg 45 of the other transfer device 23.

Figure 6:
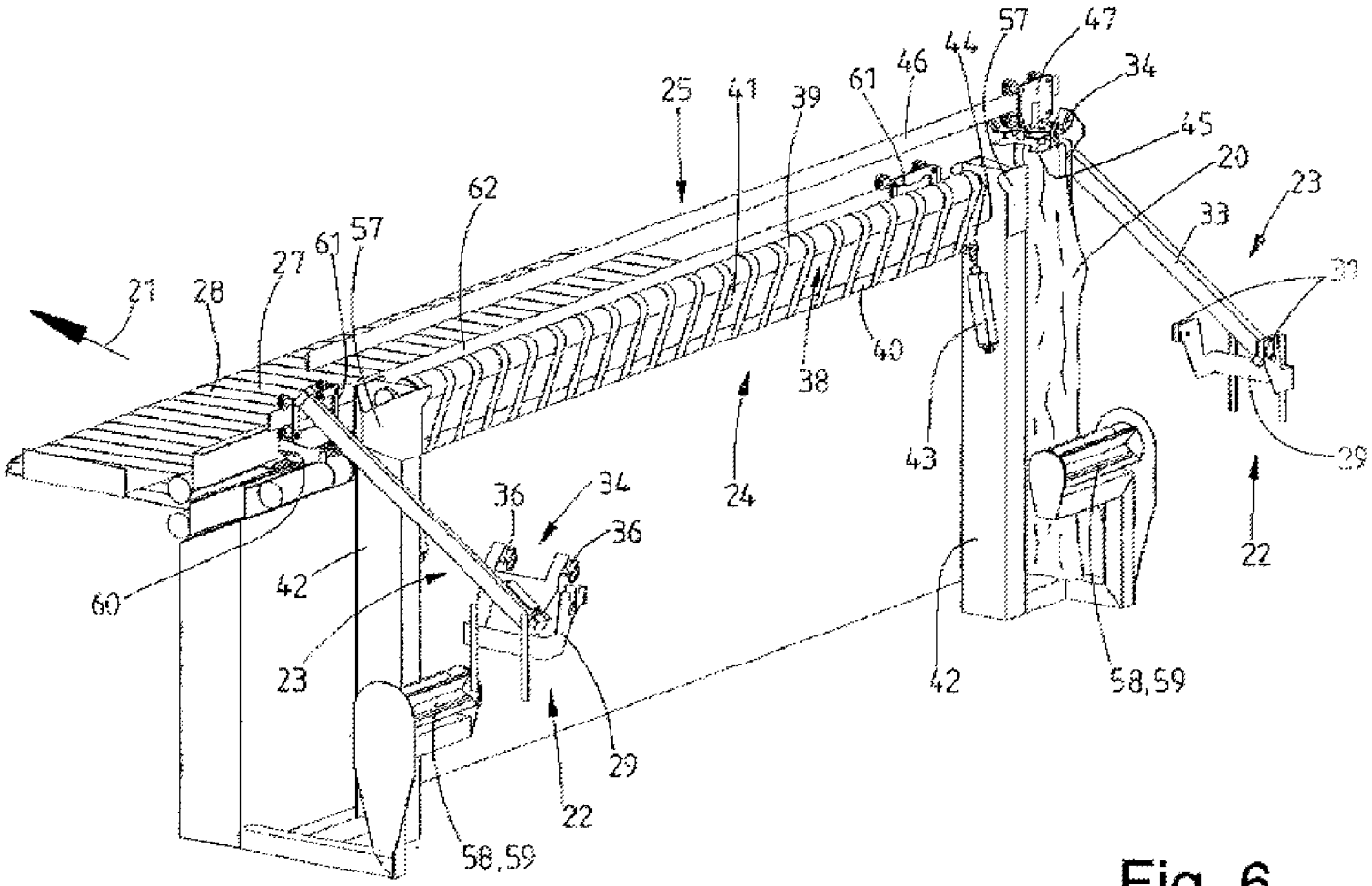
FIG. 6 shows a perspective view of the apparatus, similar to FIG. 1, during the transfer of the laundry article to the draw-on peg.
Figure 7:
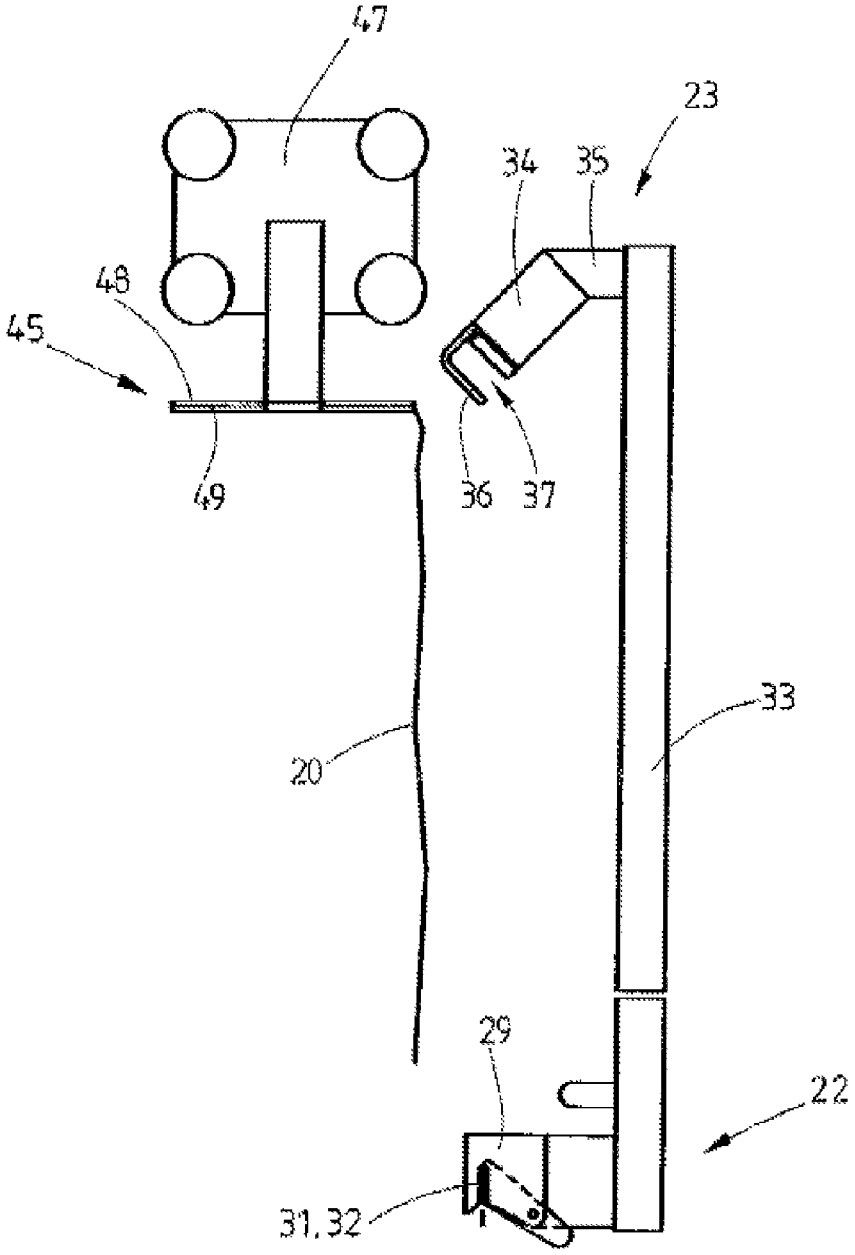
FIG. 7 shows a view, similar to FIG. 2, after the transfer of the laundry article to the draw-on peg.
Figure 8:
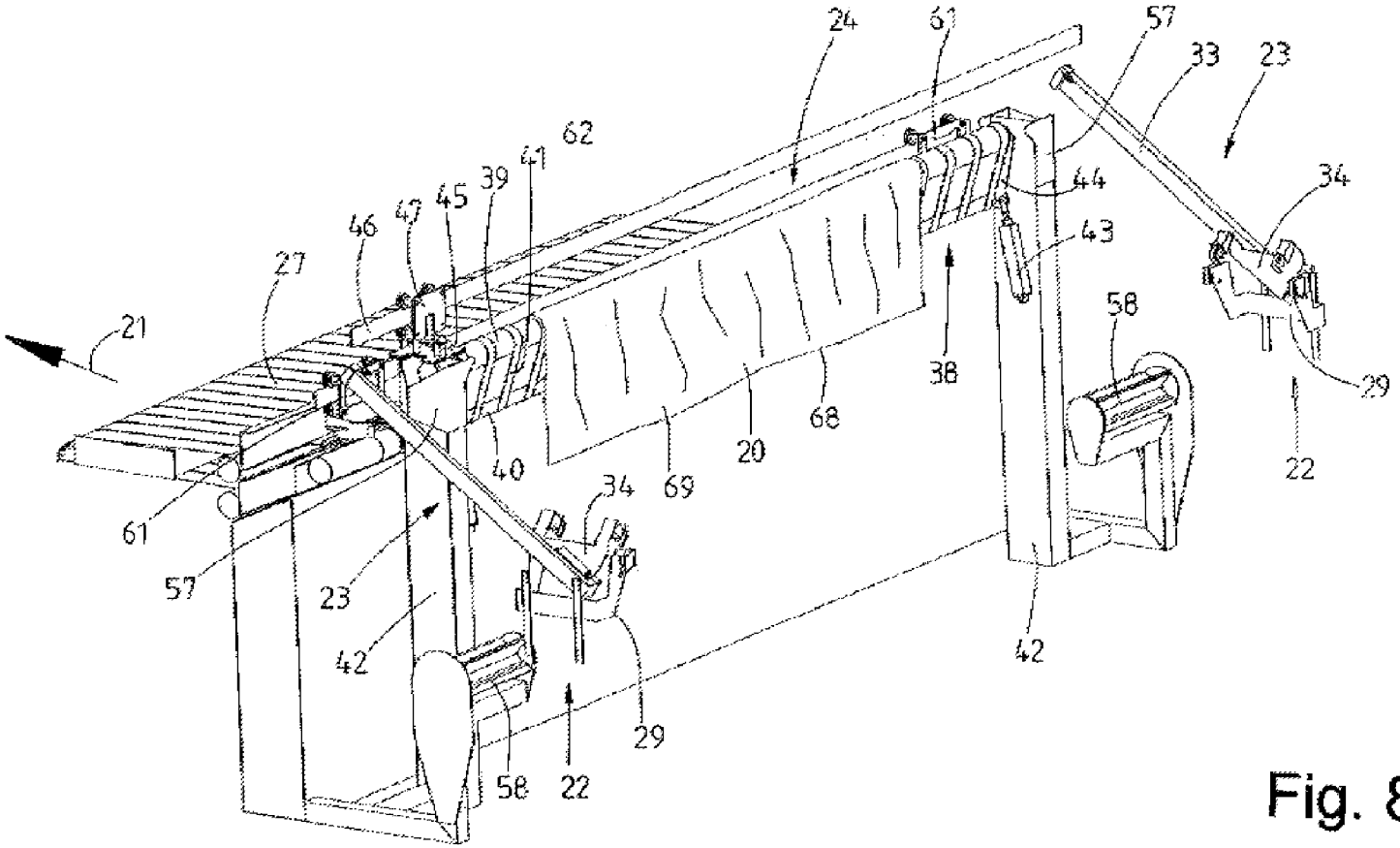
FIG. 8 shows a perspective view of the apparatus, similar to FIG. 2, with the laundry article drawn onto a draw-on device.

The draw-on peg 45 shown here has two parallel horizontal plates 48, 49. The plates 48 and 49 can be moved together and apart from one another (FIGS. 2 and 7). In the exemplary embodiment shown, the lower plate 49 is stationary, while the upper plate 48 can be moved up and down in order to open and close the draw-on peg 45. As a result of the plates 48 and 49, the draw-on peg 45 has two opposite peg jaws 50 which are both oriented horizontally and are open to opposite sides. In each case an edge region 30 of the laundry article 20 is held in a horizontal plane between the moved-together plates 48 and 49 of the draw-on peg 45 (FIG. 7). The width of the preferably identically sized plates 48, 49 (as seen transversely with respect to the feed direction 21) is selected such that the ends of the plates 48, 49 and therefore the peg jaws 50 of the draw-on peg 45 can be moved between the individual pegs 36 of the respective transfer peg 34 (FIG. 6). The draw-on peg 45 can be moved up to the transfer peg 34 of the respective transfer device 23 to an extent such that that edge region 30 of the laundry article 20 which is held obliquely at 45° by the transfer peg 34 can pass between the moved-apart plates 48 and 49 of the draw-on peg 45.

The draw-on device 24 of the apparatus shown here is assigned a holding-down device 51 which extends over the entire width of the discharge conveyor 38, that is to say the entire operating width of the apparatus. The holding-down device 51 is pivotable from a position of rest (FIG. 9) located next to the discharge conveyor 38 into an operating position (FIG. 10) in which an elongate slip-out bar 52 extending over the entire operating width presses a narrow strip of the laundry article 20 from above against the upper strand 53 of the discharge conveyor 38. The holding-down device 51 may alternatively have a slip-out brush or a freely rotatable or rotary-drivable brush roller. To pivot the slip-out bar 52 from the position of rest (FIG. 9) into the operating position (FIG. 10), the slip-out bar 52 is mounted at its opposite ends on plates 55 pivotable about fixed centers of rotation 54 in vertical planes running in the feed direction 21. The plates 55 can be pivoted about the centers of rotation 54, lying on one line parallel to the slip-out bar 52, by means of at least one pressure-medium cylinder 56 or the like.

In the apparatus shown here, the draw-on device 24 has, in front of both ends of the discharge conveyor 38, slip-out sheets 57 which are V-shaped, as seen from above. The slip-out sheets 57, in the apparatus shown here, are fastened to the upper ends of the pillars 42, the pointed sides of the V-shaped slip-out sheets 57 pointing outwards to the respective transfer device 23.

Each transfer device 23 is assigned a preconveyor 58 which, in the exemplary embodiment shown, has a rotary-drivable star drum 59. The star drum 59 is rotatable about a horizontal axis which runs transversely with respect to the feed direction 21. When the transfer peg 34 is being moved up to the draw-on peg 45, the lower part of the laundry article 20 is straightened out by the preconveyor 58, thus ensuring that, for the purpose of drawing the laundry article 20 onto the discharge conveyor 38, the entire laundry article 20 is located on the outside in front of the vertical pillar 42 at the respective end of the draw-on device 24.

The spreading device 25, arranged at a distance behind the draw-on device 24 in the feed direction 21, has two spreading pegs 60 which can be contradirectionally moved together and apart from one another and which serve at the same time as catching pegs. The spreading pegs 60, like the draw-on pegs 45 of the draw-on device 24, are arranged on running carriages 61 which can be moved together and apart from one another on a rectilinear rail 62 running transversely with respect to the feed direction 21. The rail 62 runs parallel to the rail 46 of the draw-on device 24, but is placed at a lower level than the rail 46. The rail 62 is arranged at such a distance behind the rail 46 that, when the discharge conveyor 38 of the draw-on device 24 is pivoted towards the spreading device 25 (FIG. 10), a part 67 of the laundry article which hangs down from the discharge conveyor 38 on the side of the feed conveyor 27 passes in front of the rail 62 between the spreading pegs 60 which are also moved apart from one another.

The spreading pegs 60 also serving as catching pegs have in the figures sensors, not shown, which contactlessly detect in each case a vertical edge of the laundry article 20, with the result that the spreading pegs 60 can be moved together to an extent such that the peg jaws of the spreading pegs 60 can pick up vertical edge regions emanating from the upright edges of the laundry article 20. Moreover, the spreading pegs 60 are assigned sensors, not shown, which contactlessly detect a horizontal rear edge 68 of that part 69 of the laundry article 20 which hangs down from the discharge conveyor 38 on the other side, to be precise on the side of the input station 22, in order to control the closing of the spreading pegs 60.

Figure 12:
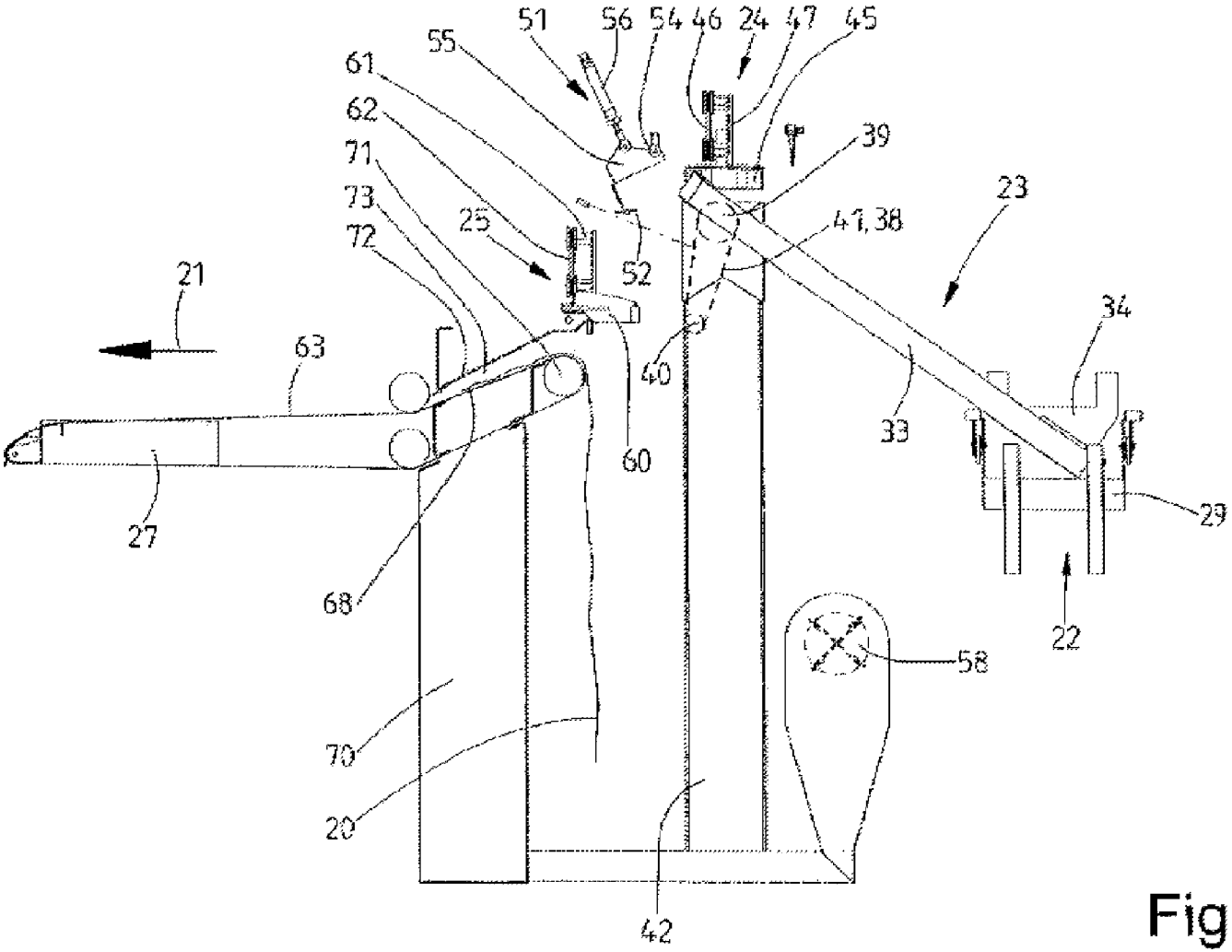
FIG. 12 shows a view of the apparatus, similar to FIG. 9, with the laundry article partially deposited onto a feed conveyor.

When the spreading pegs 60 of the spreading device 25 have grasped opposite corners of the rear edge 68 of the laundry article 20, the rear edge 68 of the laundry article 20 is stretched by the spreading pegs 60 being moved apart from one another in a directed manner. The laundry article 20 is subsequently transferred with a then front marginal region emanating from the rear edge 68 onto the feed conveyor 27. This takes place by means of suction air, specifically, preferably, a suction-air pulse which acts at right angles upon the stretched-out marginal region, emanating from the rear edge 68, of the laundry article 20. The suction air is generated by a vacuum shaft 70 below the initial region 71, pointing to the spreading device 25, of the feed conveyor 27. The conveyor belts 28 of the feed conveyor 27 are designed to be air-permeable for this purpose, so that the suction air flows through the initial region 71 of the feed conveyor 27. Arranged at a distance above the initial region 71 of the feed conveyor 27, specifically above the upper strand 63 of the latter, is a guide sheet 72, of which the distance from the upper strand 63 increases somewhat towards the spreading device 25 in the exemplary embodiment shown. The initial region 71 of the feed conveyor 27 above the upper strand 63 thereby acquires a wedge-shaped suction space 73, into which the transverse marginal region (the original rear edge 68) of the laundry article 20 is sucked after the opening of the spreading pegs 60 and is at the same time fixed on the upper strand 63 of the feed conveyor 27 in the initial region 71 (FIG. 12).

Alternatively to the exemplary embodiment shown, it is conceivable to provide, above the initial region 71 of the feed conveyor 27, a lay-on strip which is movable in the feed direction 21 and can be acted upon with suction air and on which the front transverse marginal region of the laundry article 20 is transferred and fixed after the opening of the spreading pegs 60. The laundry article 20 is then deposited with the stretched front marginal region on the feed conveyor 27 by the depositing strip.

Figure 13:
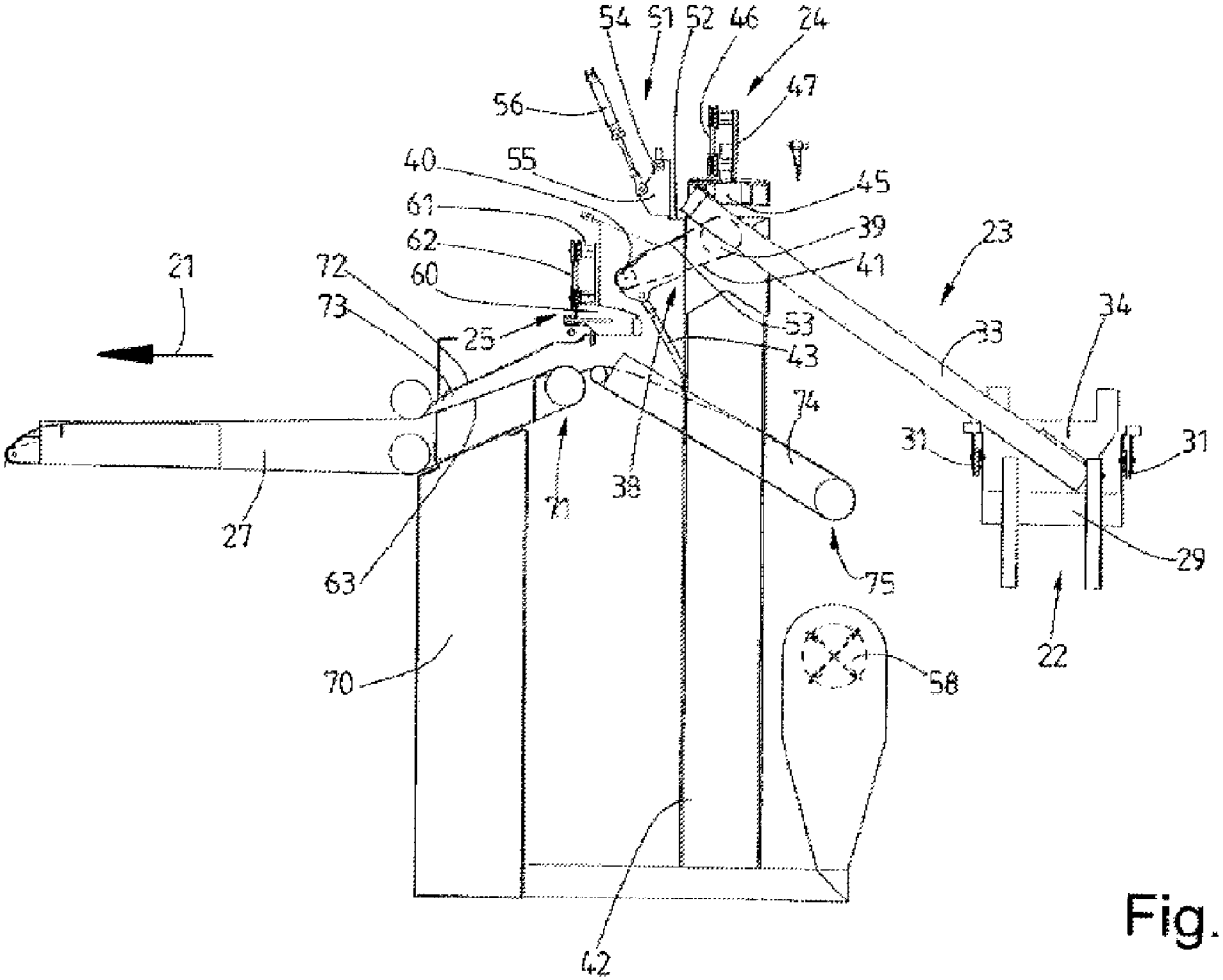
FIG. 13 shows the apparatus to the direct transfer of the laundry article to the feed conveyor in a side view according to FIG. 9.

In the apparatus shown here, a pivotable preconveyor 74 is also provided. The preconveyor 74 can be arranged in front of the feed conveyor 27, particularly when smaller laundry articles 20 are spread out and input by hand. The preconveyor 74 extends through a free space below the draw-on device 24 and between the pillars 42 (FIG. 13). A front end 75 of the preconveyor 74, designed as a belt conveyor, is located, in the position of use, in front of and below the draw-on device 24, so that operators can deposit laundry articles 20 in front of the apparatus directly onto the front end 75 of the preconveyor 74. When not in use, the preconveyor 74 is pivoted down into an approximately vertical position, so that it is located below the initial region 71 of the feed conveyor 27 and in front of the vacuum shaft 70.

The method according to the invention is explained in more detail below:

At each input station 22, in each case a laundry article 20 is suspended by an operator with a stretched-out edge region 30, which preferably extends over a short middle part-region of a margin of the laundry article 20, on the individual pegs 31 of the respective input peg 29. The laundry article 20 and also the edge region 30 in this case hang vertically under the respective input peg 29, the edge region 30 extending in the feed direction 21 or running parallel thereto. When the edge region 30 is being input into the input pegs 29, it is in its lowered, lower initial position (FIG. 1). As soon as a transfer peg 34 of the respective transfer device 23 is empty, it is moved into a take-over position onto the lower end of the rail 33 of the transfer device 23. In this case, the individual pegs 36 of the transfer peg 34 are located above the input peg 29, specifically between the individual pegs 31 of the latter (FIGS. 1 and 2). To transfer the laundry article 20 to the transfer peg 34, the input peg 29 is moved up vertically, the edge region 30 of the laundry article 20 passing from below into the open peg jaws 37 of the transfer peg 34. The individual pegs 31 of the input peg 29 are then opened and moved downwards into the initial position again. The laundry article 20 then hangs under the transfer peg 34, the edge region 30 being angled at about 45° with respect to the vertical. Alternatively, it is also conceivable to input a stretched edge region of each laundry article 20 directly in each case into a transfer peg 34 by the operator.

The laundry article 20 hanging under the transfer peg 34 is then moved by the latter from the input station 22 in front of the respective end of the draw-on device 24. For this purpose, the transfer peg 34 is moved up by means of its slide 35 on the rail 33 rectilinearly in the feed direction 21 or parallel thereto as a result of the obliquely ascending run of the rail 33. In this case, the laundry article 20 is moved, in the plane in which it hangs under the transfer peg 34, in front of the respective end of the draw-on device 24 and at the same time raised. According to the invention, a reorientation of the laundry article 20 on the path to the draw-on device 24 does not take place. The laundry article 20 is simply moved, while maintaining the plane in which it hangs down from the transfer peg 34, to the draw-on device 24 in the feed direction 21, that is to say it is displaced and at the same time raised in the plane in which it hangs, so that it preferably hangs down completely freely under the transfer peg 34 when the latter is located in front of one end of the draw-on device 24 (FIG. 6). During the movement of the transfer peg 34 to the end of the draw-on device 24, the lower part of the laundry article 20 is moved via the preferably rotary-driven star drum 59, with the result that the lower part of the laundry article 20 is straightened out, so that the latter hangs freely under the transfer peg 34 in the transfer position.

When the transfer peg 34 with the laundry article 20 is in the transfer position at the upper end of the rail 33 of the transfer device 23, the empty draw-on peg 45 fetches the laundry article 20 from the transfer device 23. The empty, open draw-on peg 45 is, for this purpose, moved to that end of the rail 46 which points towards the respective transfer device 23. In this case, the horizontally oriented peg jaw 50, pointing to the transfer peg 34, of the draw-on peg 45 engages between the individual pegs 36 of the transfer peg 34. By the upper plate 48 being moved down against the lower plate 49, the draw-on peg 45 is closed and the laundry article 20 is clamped in the edge region 30 in the draw-on peg 45. In this case, the edge region 30 is oriented approximately horizontally, while the remaining part of the laundry article 20 hangs vertically down from the draw-on peg 45.

As soon as the draw-on peg 45 has taken over the laundry article 20, it is moved by means of its running carriage 47 along the rail 46 transversely with respect to the feed direction 21. In this case, the laundry article 20 is laid, U-shaped, around the wedge-like slip-out sheet 57 at the upper end of the respective pillar 42, with the result that the laundry article 20 is drawn onto the discharge conveyor 38 of the draw-on device 24 such that it hangs down with the parts 67 and 69 from the discharge conveyor 38 on both sides. When the laundry article 20 is being drawn on and drawn over completely via the draw-on device 24, the upper strand of the discharge conveyor 38 is in a for the most part pivoted-down draw-on position (FIG. 9). The laundry article 20 then hangs essentially above the upper roller 39 of the discharge conveyor 38.

After the laundry article 20 has been drawn completely onto the discharge conveyor 38 and has been released from the draw-on peg 45, in order to prepare for the transfer of the laundry article 20 to the spreading device 25 the discharge conveyor 38 is pivoted upwards, in that the lower roller 40 is pivoted about the upper roller 39, specifically, in the exemplary embodiment shown, clockwise over about 30° to 60° (FIG. 10). A widening of the draw-on device 24 thus takes place. In the exemplary embodiment shown, the draw-on device 24 is widened by means of an increase in size of the upper strand 53 of the discharge conveyor 38. During the widening of the upper strand 53 of the discharge conveyor 38, the parts 67 and 69 of the laundry article 20 which hang down from the latter are spaced further apart from one another, specifically the front part 67, directed towards the feed conveyor 27, of the laundry article 20 is spaced further apart from the rear part 69, remaining in an unchanged position, of the laundry article 20 (cf. FIGS. 9 and 10).

As a result of the widening of the discharge conveyor 38, the (front) part 67, hanging down from the discharge conveyor 38 on the side of the feed conveyor 27, of the laundry article 20 is brought between the spreading pegs 60 moved apart from one another. The opposite, laterally vertically longitudinal margins of the laundry article 20 consequently lie between the moved-apart spreading pegs 60. The discharge conveyor 38 is then driven, specifically such that the laundry article 20 is transported in the feed direction 21 over the upper strand 53 of the discharge conveyor 38, with the result that the front edge on the lower part 67 of the laundry article 20 moves downwards between the draw-on device 24 and the feed conveyor 27 and at the same time the rear part 69 of the laundry article 20 is transported over the discharge conveyor 38. So that the rear part 69 of the laundry article 20 does not in this case slide off from the upper strand 53 of the discharge conveyor 38, the slip-out bar 52 is pivoted, so that it presses the laundry article 20 from above against the upper strand 53 of the discharge conveyor 38 and the laundry article 20 is thus fixed on the upper strand 53 of the discharge conveyor 38.

As soon as the part 67 of the laundry article 20 is located between the spreading pegs 60, the corresponding sensors of the spreading device 25 detect the vertical longitudinal edges of the laundry article 20. On the basis of the width, contactlessly detected by the sensors, of the laundry article 20, the spreading pegs 60 are moved together, so that vertical longitudinal marginal regions of the laundry article 20 engage into the peg jaws of the spreading pegs 60. The rear edge 68 of the laundry article 20 is detected contactlessly by other sensors, specifically, preferably, when the laundry article is still located on the upper strand 53 of the discharge conveyor 38. A specific time after the detection of the rear edge 68 of the laundry article 20 on the discharge conveyor 38, the spreading pegs 60 are closed, with the result that the spreading pegs 60 automatically grasp the opposite corners of the rear edge 68 of the laundry article 20.

If appropriate, a possible skewing of the rear edge 68 can be eliminated by means of the time-offset closing of the spreading pegs 60, so that the rear edge 68, oriented horizontally, can be caught and clamped by the spreading pegs 66 of the spreading device 25.

After the spreading pegs 60 have automatically caught opposite corners of the rear edge 68 of the laundry article 20, the spreading pegs 60 are moved apart from one another contradirectionally and at the same time stretch out the rear edge 68 of the laundry article 20. The original rear edge 68 of the laundry article 20 then forms a transverse edge with which the laundry article 20 is first deposited onto the feed conveyor 27.

Figure 11:
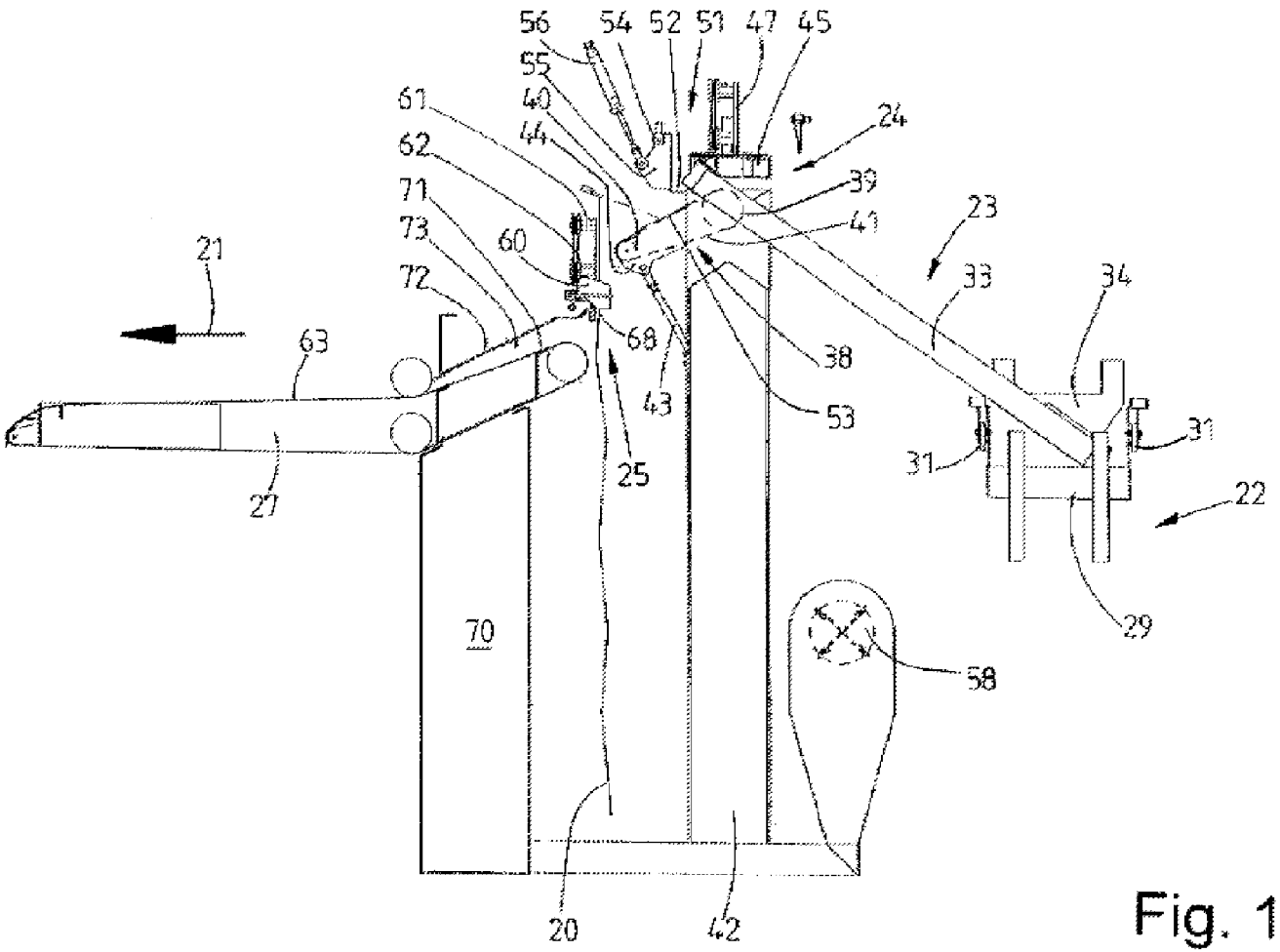
FIG. 11 shows a view of the apparatus, similar to FIG. 9, after the transfer of the laundry article to the spreading pegs.

As soon as the spreading device 25 has spread out the laundry article centrally in front of the feed conveyor 27 (FIG. 11), the discharge conveyor 38 is pivoted back into the initial position in order to draw on a following laundry article 20 (FIG. 12). Moreover, a vacuum is generated in the upper strand 63 under the initial region 71 of the feed conveyor 27. An air draught is thereby generated through the conveyor belts 28 of the initial region 71 of the feed conveyor 27 in the suction space above the upper strand 63 of the feed conveyor 27, specifically between the upper strand 63 and the guide sheet 72. By means of this air draught, after the opening of the spreading pegs 60, a horizontal transverse marginal region, emanating from the rear edge 68, of the laundry article 20 is sucked into the suction space 73 and fixed on the air-permeable upper strand 53 of the feed conveyor 27 (FIG. 12). The laundry article 20 is then transported in the spread-out state with the original rear edge 68, stretched out by the spreading device 25, first, over the upper strand 53 of the feed conveyor 27 to the mangle or another laundry treatment device.

If laundry articles which are not to be deposited automatically onto the feed conveyor 27 are to be fed to the mangle by means of the apparatus, the apparatus can be changed over to a manual input. For this purpose, the preconveyor 74 is provided, which is normally pivoted back into an approximately vertical position under the front end 75 of the feed conveyor 27. For manual input, the preconveyor 74 is pivoted out, so that it prolongs the upper strand 63 of the feed conveyor 27. In this case, the preconveyor 74 extends through the draw-on device 24, specifically under the discharge conveyor 38 and between the pillars 42 (FIG. 13). When the preconveyor 74 is no longer required, it is pivoted back again into its position of rest in front of the suction space 73 and under the initial region 71 of the feed conveyor 27.

List of reference symbols:

| | |
|---|---|
| 10 | Laundry article |
| 21 | Feed direction |
| 22 | Input station |
| 23 | Transfer device |
| 24 | Draw-on device |
| 25 | Spreading device |
| 27 | Feed conveyor |
| 28 | Conveyor belt |
| 29 | Input peg |
| 30 | Edge region |

-continued

| List of reference symbols: | |
|---|---|
| 31 | Individual peg |
| 32 | Peg jaw |
| 33 | Rail |
| 34 | Transfer peg |
| 35 | Slide |
| 36 | Individual peg |
| 37 | Peg jaw |
| 38 | Discharge conveyor |
| 39 | Roller |
| 40 | Roller |
| 41 | Belt |
| 42 | Pillar |
| 43 | Pressure-medium cylinder |
| 44 | Pivoting arm |
| 45 | Draw-on peg |
| 46 | Rail |
| 47 | Running carriage |
| 48 | Plate |
| 49 | Plate |
| 50 | Peg jaw |
| 51 | Holding-down device |
| 52 | Slip-out bar |
| 53 | Upper strand |
| 54 | Center of rotation |
| 55 | Plate |
| 56 | Pressure-medium cylinder |
| 57 | Slip-out sheet |
| 58 | Preconveyor |
| 59 | Star drum |
| 60 | Spreading peg |
| 61 | Running carriage |
| 62 | Rail |
| 63 | Upper strand |
| 67 | Part |
| 68 | Rear edge |
| 69 | Part |
| 70 | Vacuum shaft |
| 71 | Initial region |
| 72 | Guide sheet |
| 73 | Suction space |
| 74 | Preconveyor |
| 75 | Front end |

What is claimed is:

1. A method for feeding a laundry article (20) to a mangle, comprising the steps of:

transferring the laundry article (20) from at least one transfer device (23) to a draw-on device (24);

drawing the laundry article (20) over the draw-on device (24);

depositing the laundry article onto a feed conveyor (27) which inputs the spread-out laundry article (20) into the mangle; and transferring, by the at least one transfer device (23), the laundry article (20) hanging at least partially in one plane in the same plane into a transfer position to the draw-on device (24), which plane is perpendicular to a draw-on direction in which the laundry article (20) is drawn onto the draw-on device (24).

2. The method according to claim 1, wherein the laundry article (20) is transported in a vertical plane into the transfer position by the at least one transfer device (23), and this vertical plane is intersected perpendicularly by the draw-on direction in which the laundry article (20) is drawn onto the draw-on device (24).

3. A method for feeding a laundry article (20) to a mangle, comprising the steps of:

drawing the laundry article (20) over a draw-on device (24), so that parts (67, 69) of the laundry article (20) hang down on both sides from the draw-on device (24);

depositing the spread-out laundry article (20) onto a feed conveyor (27) which feeds the laundry article (20) in the spread-out state to the mangle;

increasing the spacing between the parts (67, 69) of the laundry article (20) which hang down from the draw-on device (24); and moving that part (67) of the laundry article (20) which points towards the feed conveyor (27) in the direction towards the feed conveyor (27).

4. The method according to claim 3, wherein that part (67) of the laundry article (20) is moved in the direction towards the feed conveyor (27) as a result of the pivoting of a discharge conveyor (38) of the draw-on device (24).

5. A method for feeding a laundry article (20) to a mangle, comprising the steps of:

transporting the laundry article (20) to a draw-on device (24) by at least one transfer device (23);

drawing the laundry article (20) onto the draw-on device (24);

transferring the laundry article (20) to a feed conveyor (27) which feeds the laundry article (20) in the spread-out state to the mangle;

manually inputting the laundry article (20) with an edge region (30) into an input peg (29) of the at least one transfer device (23); and transferring the laundry article (20) from the input peg (29) to a transfer peg (34) of the at least one transfer device (23); and transferring the laundry article (20) from the transfer peg (34) to a draw-on peg (45) of the draw-on device (24).

6. The method according to claim 5, wherein the edge region (30) of the laundry article (20) is held in a specific orientation by the respective input peg (29), and the edge region (30) is held in a different orientation by the draw-on peg (45).

7. The method according to claim 5, wherein the edge region (30) of the laundry article (20) is held by the transfer peg (34) in an orientation which deviates from the orientation of the edge region (30) both in the input peg (29) and in the draw-on peg (45).

8. An apparatus for feeding a laundry article (20) to a mangle, comprising:

at least one transfer device (23), with a draw-on device (24) extending transversely with respect to the feed direction (21) of the laundry article (20) to the mangle; and a feed conveyor (27) for feeding the spread-out laundry article (20) to the mangle;

wherein the transfer device (23) has a rectilinear conveying section which runs transversely with respect to the draw-on direction of the laundry article (20) onto the draw-on device (20).

9. The apparatus according to claim 8, wherein the rectilinear conveying section of the respective transfer device (23) runs upwards towards the draw-on device (24).

10. An apparatus for feeding a laundry article (20) to a mangle, comprising:

at least one transfer device (23) having a transfer peg (34), with a draw-on device (24) extending transversely with respect to the feed direction (21) of the laundry articles (20) to the mangle; and a feed conveyor (27) for feeding the spread-out laundry article (20) to the mangle, wherein the transfer peg (34) of the at least one transfer device (23) is assigned an input peg (29), and wherein the transfer peg (34) and the input peg (29) in each case hold an edge region (30) of the laundry article (20), the transfer peg (34) holding the edge region (30) of the laundry article (20) so as to be angled with respect to the edge region (30) held in the input peg (31).

11. The apparatus according to claim 10, wherein a draw-on peg (45) of the draw-on device (24) holds the edge region (30) at right angles to the input peg (29), and the transfer peg (34) holds the edge region (30) in an orientation which lies between the orientations of the edge region (30), which run at right angles to one another, on the input peg (29) and on the draw-on peg (45).

12. The apparatus according to claim 10, wherein the input peg (29) is movable rectilinearly to the transfer peg (34) for the transfer of the edge region (30) of the laundry article (20) to the transfer device (23), in a plane in which the laundry article (20) is movable by the transfer peg (34) into a transfer position to the draw-on peg (45).

13. An apparatus for feeding a laundry article (20) to a mangle, comprising:

at least one transfer device (23), with a draw-on device (24) extending transversely with respect to the feed direction (21) of the laundry articles (20) to the mangle; and a feed conveyor (27) for feeding the spread-out laundry article (20) to the mangle;

wherein the draw-on device (24) has a draw-on conveyor of variable width, the conveying direction of which corresponds to the feed direction (21) of the laundry article (20) to the mangle.

14. The apparatus according to claim 13, wherein an upper strand (53) of the draw-on conveyor, onto which upper strand the laundry article (20) can be drawn, is widenable in the direction towards the feed conveyor (27) after the laundry article (20) has been drawn on.

15. The apparatus according to claim 14, wherein the draw-on conveyor is a belt conveyor with two parallel rollers (39, 40), one roller (40) being pivotable about another, fixed roller (39), in such a way that the pivotable roller (40) is located either at least partially under or next to the fixed roller (39).

* * * * *